US006062447A

United States Patent [19]

Longley

[11] Patent Number: 6,062,447

[45] Date of Patent: May 16, 2000

[54] MOLDED QUICK-RELEASE BUCKLE AND FOREARM SUPPORT STRAP

[76] Inventor: Halliwell M. Longley, 918 England St., Huntington Beach, Calif. 92648

[21] Appl. No.: 09/122,999

[22] Filed: Jul. 28, 1998

Related U.S. Application Data

[63] Continuation-in-part of application No. 08/891,201, Jul. 10, 1997, abandoned.

[51] Int. Cl.[7] ..... A45F 5/00; F21L 15/08

[52] U.S. Cl. ..... 224/222; 224/221; 224/267; 224/272; 224/930; 362/103

[58] Field of Search ..... 224/222, 221, 224/219, 267, 220, 930, 271, 272; 362/103, 108

[56] References Cited

U.S. PATENT DOCUMENTS

| | | | |
|---|---|---|---|
| 1,268,622 | 6/1918 | Reynolds | 362/103 |
| 1,318,850 | 10/1919 | De Young | 362/103 |
| 1,320,934 | 11/1919 | Schopp. | 362/103 |
| 1,769,241 | 7/1930 | Stephani | 362/103 |
| 1,923,962 | 8/1933 | Worley | 362/103 |
| 2,024,281 | 12/1935 | Gaskin | 362/103 |
| 2,165,625 | 7/1939 | Fessel | 224/219 |
| 3,112,889 | 12/1963 | Marmo et al. | 362/103 |
| 4,788,631 | 11/1988 | Fuller | 362/103 |
| 5,154,506 | 10/1992 | Leard | 362/103 |
| 5,309,328 | 5/1994 | Lum | 361/809 |

*Primary Examiner*—Linda J. Sholl

[57] ABSTRACT

A flashlight holder and quick-release mechanism comprising a molded high impact resistant plastic unit to facilitate hands-free flashlight operation and quick-release use of the flashlight independent from the forearm mounted strap. The device additionally comprises straps of elastic and neoprene material sewn together to make a reinforced support strap with pocket areas. The molded plastic base unit, with radius curvature shape to the contours of a person's forearm, is mounted to the support strap using plastic rivets. A flashlight fits into the semi-circular portion of the upper part of the flashlight holder. It is attached to the base unit by utilizing a male-sided quick-release buckle with a dual push button release mechanism, which attaches to the base unit. The flashlight holder locks securely into the forearm mounted base unit to provide for a hands-free quick-release flashlight holder system.

4 Claims, 4 Drawing Sheets

MOLDED QUICK-RELEASE BUCKLE AND FOREARM SUPPORT STRAP

This application is a continuation-in-part of Ser. No. 08/891,201 filed Jul. 10, 1997, now abandoned.

FIELD OF INVENTION

This invention relates generally to flashlight holding or supporting devices. More particularly, this invention relates to devices for attaching or supporting a flashlight on the forearm of a person and providing a dual push button quick-release mechanism.

BACKGROUND OF THE INVENTION

This invention is the field of flashlight holding devices particularly those, which can be utilized, in both stationary and mobile applications. For all nighttime activities, work or play there is a need for a hands-free light source, which illuminates wherever the hand is pointed and provides for a secure attachment and quick-release mechanism. A number of devices have been previously proposed to address this issue which involve some type of mechanical holder which engages a flashlight, see for example, the following US patents:

U.S. Pat. No. 1,268,622 June 1918 Reynolds . . . 362/103 SEARCH LIGHT HOLDER

U.S. Pat. No. 1,318,850 October 1919 De Yong . . . 362/103 ELECTRIC FLASHLIGHT HOLDER U.S. Pat. No. 1,320,934 November 1919 Schopp . . . 362/103 FLASHLIGHT ATTACHMENT U.S. Pat. No. 1,769,241 July 1930 Stephani . . . 362/103 WRIST ATTACHMENT FOR FLASHLIGHT U.S. Pat. No. 1,923,962 August 1933 Worley . . . 362/103 FLASHLIGHT U.S. Pat. No. 2,024,281 December 1935 Gaskin . . . 362/103 LIGHT U.S. Pat. No. 2,165,625 July 939 Fessel . . . 224/219 BRACELET FLASHLIGHT HOLDER U.S. Pat. No. 3,112.889 December 1963 Marmo et al . . . 362/103 WRIST MOUNTED FLASHLIGHT U.S. Pat. No. 4,788,631 November 1988 Fuller . . . 362/103 WRIST MOUNTED FLASHLIGHT U.S. Pat. No. 5,154,506 October 1992 Leard . . . 362/103 FLASHLIGHT ARMBAND U.S. Pat. No. 5,309,328 May 1994 Lum . . . 361/809 HANDSFREE FOREARM STRAP FOR PORTABLE EQUIPMENT The devices described in all of the foregoing patents are characterized by some type of mounting device which attaches a flashlight to the forearm or wrist. In all cases the design is such that a device is intended to function when attached to the forearm or wrist.

There is need for a push button quick-release flashlight holder, which can be easily and securely locked and unlocked from the forearm base unit. The above mentioned devices do not meet this need as they have a common design for portable attachment without the unique push button and quick-release design.

SUMMARY OF INVENTION

This invention fulfills the above stated need by providing a system comprising of a molded quick-release forearm base unit that is mounted to an elastic/neoprene support strap. The flashlight holder unit locks securely into the base unit.

The forearm strap can be readily adjusted using hook and loop strips to securely fit any size forearm and has sewn pocket areas for holding additional objects. The push button quick-release feature provides for a quick and easy release mechanism from the base unit.

Other advantages of the system of the present invention will be apparent from the following detailed description. The invention is described in more detail hereinafter with reference to the accompanying drawings.

BRIEF DESCRIPTION OF THE INVENTION

DETAILED DESCRIPTION OF THE DRAWINGS

Figure 1:
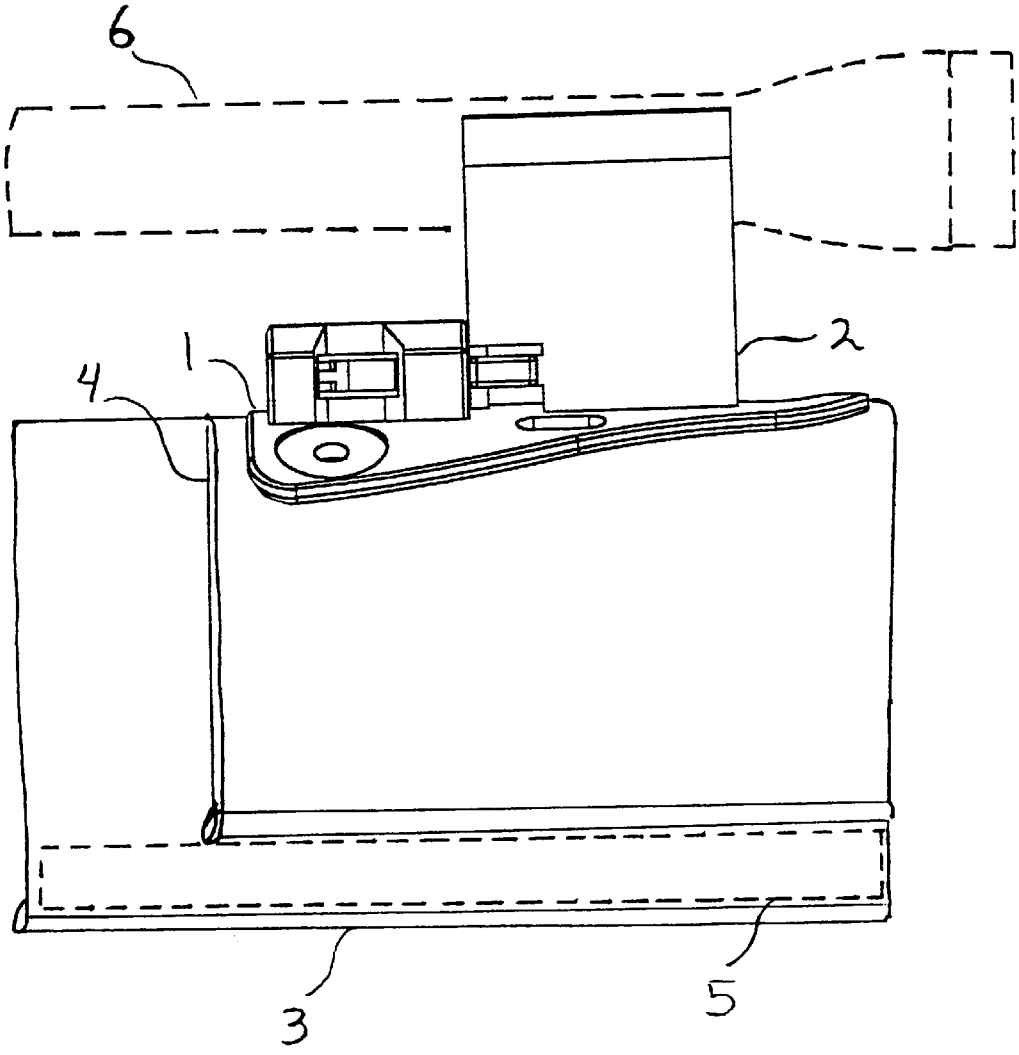
FIG. 1 is a side view of one embodiment of the invention, comprising the female sided and molded quick-release base member with the male sided quick-release buckle flashlight holder, with inserted flashlight, the base member attaches to the elastic/neoprene support strap using plastic lock rivets.

In it's preferred form the molded quick-release buckle and flashlight holder system shown in FIG. 1 of the invention comprises three basic components; 1) The curved molded plastic base member with female sided quick-release buckle (1) which serves as the platform to attach the flashlight holder (2); 2) The flashlight holder (2) comprises a semi-circular support (9) with dual push button release mechanism (8) which is is used to hold objects including flashlights, that connects securely into the base member (1); 3) The elastic/neoprene support strap (3) fits securely on a person's forearm using hook and loop fasteners (5), and provides a surface to mount the base member (1) onto the support strap (3) using plastic lock rivets (11).

The base member (1) is preferably molded of high impact resistant plastic material with a radius of curvature which is consistent with the shape of a person's forearm (10). As illustrated in FIG.1, the base member (1) with the attached flashlight holder (2), provides for a high mounted flashlight position, approximately 2 inches above the base member (1) and is mounted with plastic locking rivets (11) to the elastic/neoprene forearm support strap (3) as illustrated in FIG. 1.

Figure 2:
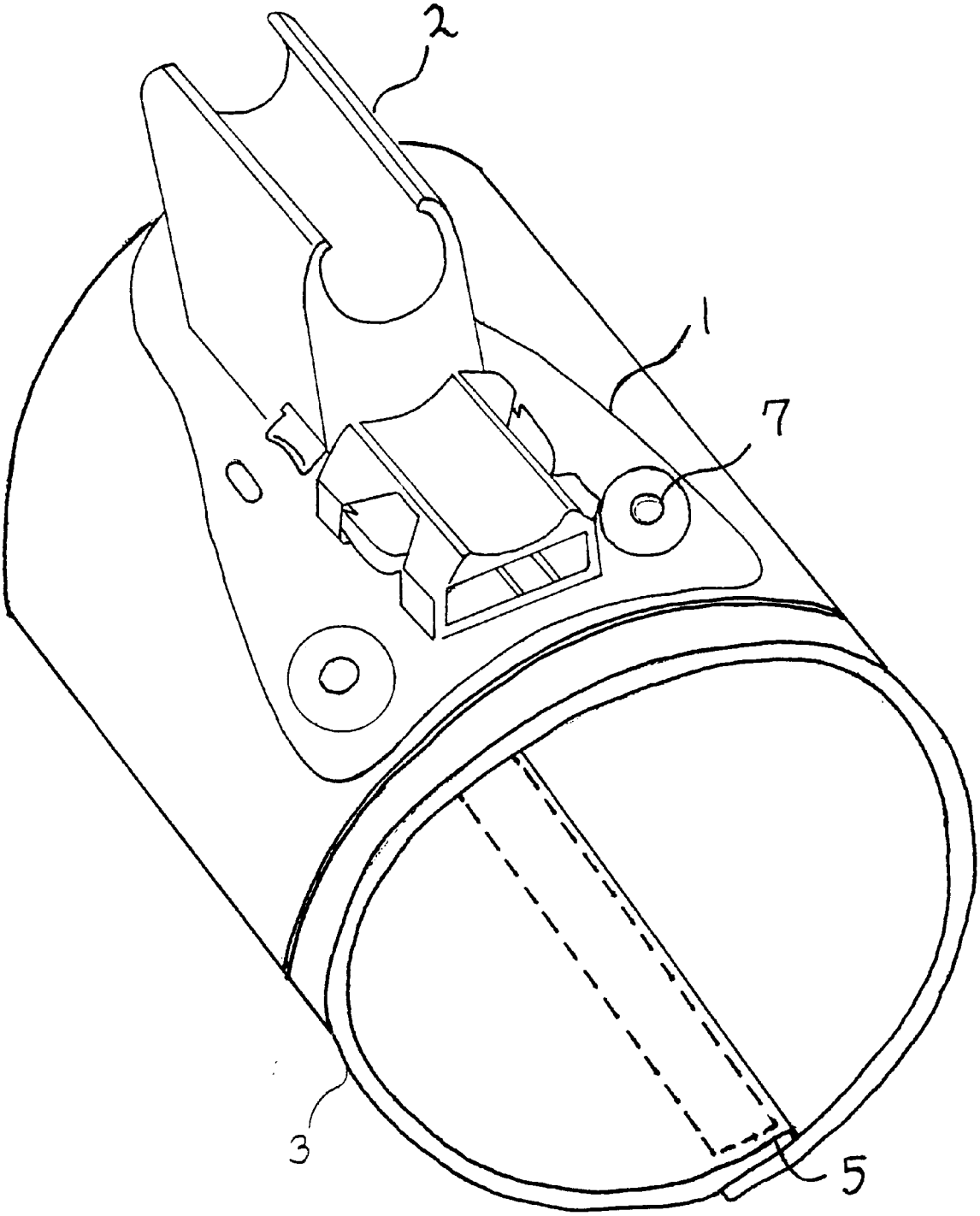
FIG. 2 is a perspective of FIG. 1 showing the flashlight holder attached to the base member, and the forearm support strap with hook and loop strips to secure on to a person's forearm.

As illustrated in FIG. 2, the base member (1) with locking rivets (11) mounts onto the forearm support strap (3) and uses a double row of hook and loop strips (5) on the ends of the support strap (3) to secure it tightly to a person's forearm. The forearm support strap (3) has a layer of elastic and neoprene which creates a pocketed area (4) to insert objects.

Figure 3:
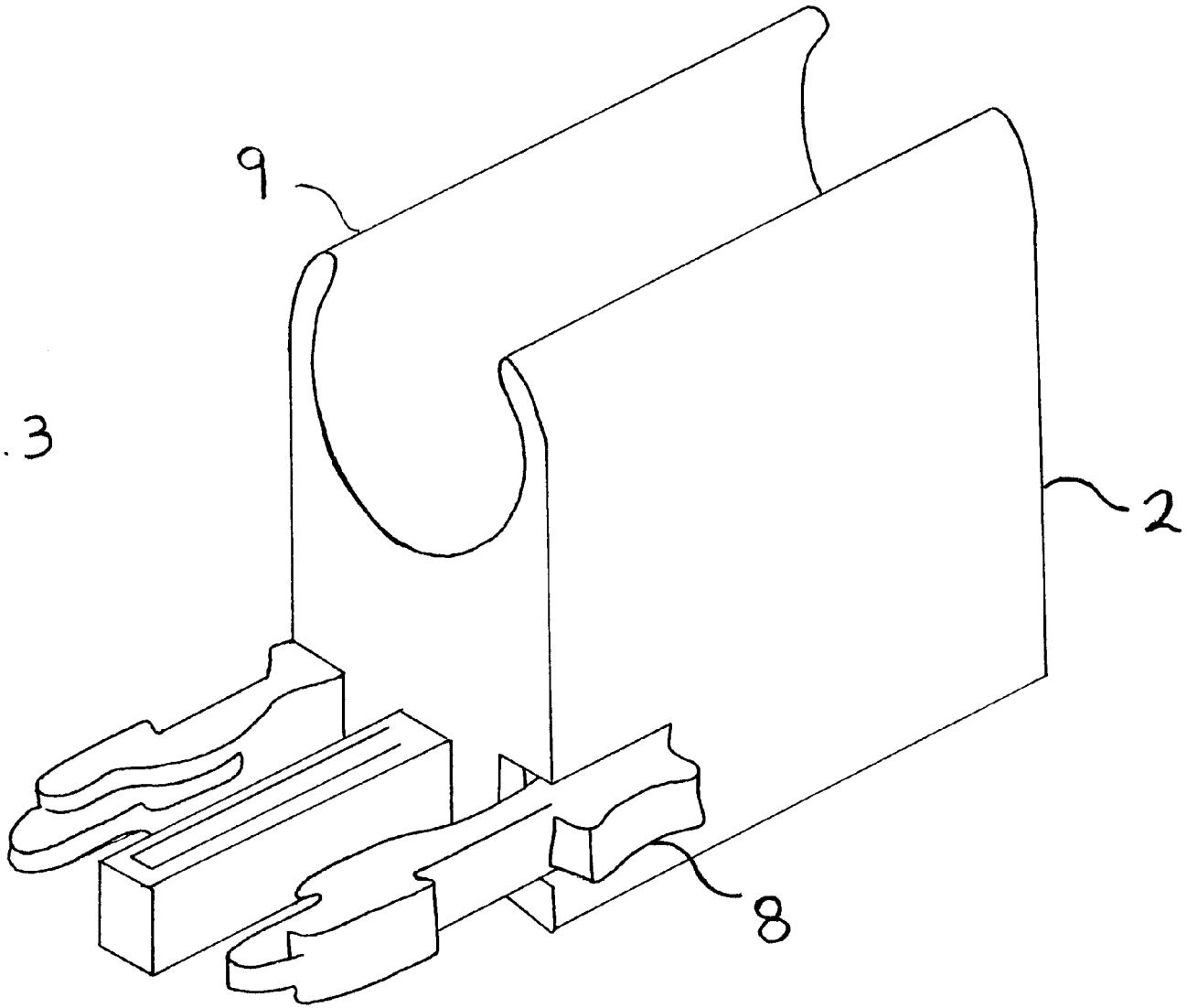
FIG. 3 is a view of the male sided flashlight holder with quick-release dual push button release mechanism.

As illustrated in FIG. 3, there are dual push button release mechanisms (8) on the sides of the unit which release the flashlight holder (2) from the base member (1).

Figure 4:
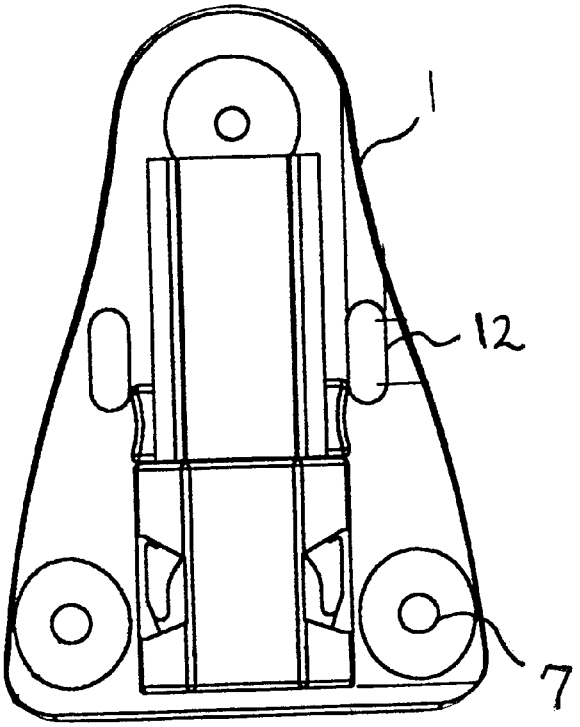
FIG. 4 is a perspective showing a top view of the female sided quick-release base member, with the attached male sided flashlight holder.
Figure 5:
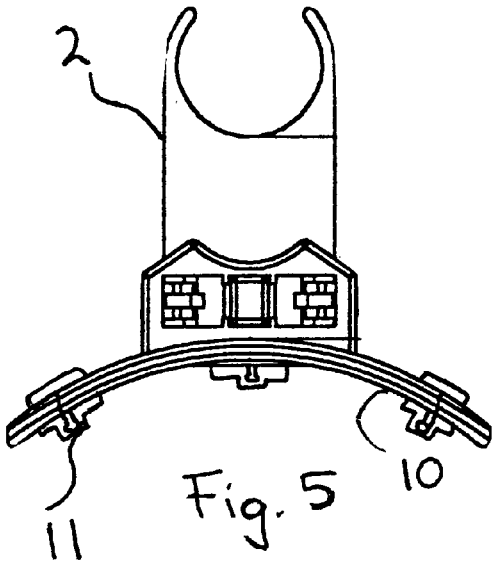
FIG. 5 is a front view of the female sided quick-release base member; with the attached male sided flashlight holder.
Figure 6:
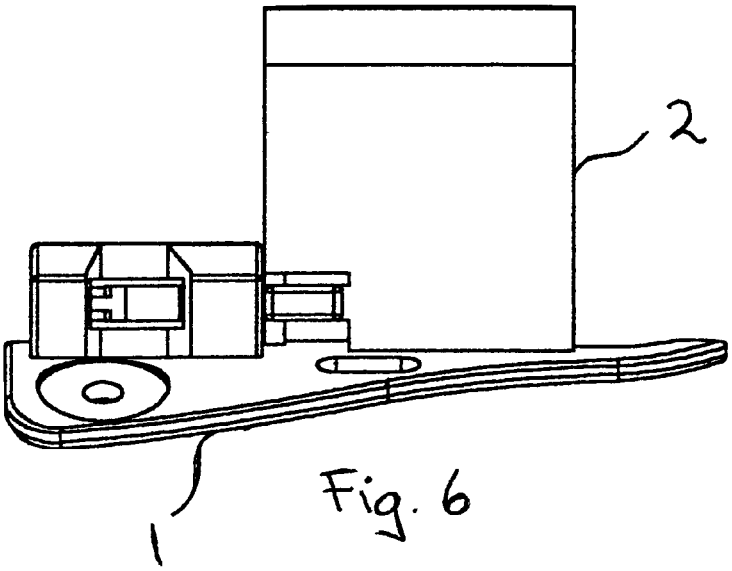
FIG. 6 is a side view of the female sided quick-release base member, with the attached male sided flashlight holder.

As illustrated in FIG. 4 is a top view of the base member (1), and illustrates the rivet holes (7) and keyring holes (12);

As illustrated in FIG. 5 is a front view of the base member (1) and illustrates the radius of curvature (10) consistent with the contour of a person's forearm and showing the configuration of lock rivets (11) which attach to the elastic/neoprene support strap (3);

FIG. 6 illustrates a side view of the base member (1) with flashlight holder (2) in the attached position.

From the above description taken in connection with the accompanying drawings, it is thought that a clear and comprehensive understanding of the construction and operation of my invention may be had, and while I have shown and described the device as embodying a specific structure, I desire that it be understood that such changes may be made in said structure as do not depart from the spirit and scope of the invention.

Having thus described my invention, I claim:

1. A flashlight holder system for holding a flashlight on a person comprising:

a molded base member having an integrated quick-release female buckle and being formed with a radius of curvature consistent with the shape of a person's forearm;

a curved semi-circular flashlight holder having an integrated male quick-release buckle and means for holding the flashlight;

one of said female buckle and said male buckle having a dual push button quick-release mechanism to allow said holder to attach to said base member;

a flexible elastic/neoprene forearm strap attached to said base member, means for attaching said forearm strap to said base member;

said forearm strap being constructed of two layers of material to form at least one pocket for holding objects;

and said forearm strap having first and second ends with fasteners for adjustably securing the system to the forearm.

2. A system in accordance with claim 1, wherein said fasteners are loop and hook fasteners.

3. A system in accordance with claim 1, wherein said flashlight holder is positioned on said base to allow the flashlight to provide illumination above a hand of a person.

4. a system in accordance with claim 1, wherein the base member further comprises holes formed on each side of the base member for holding a ring to allow attachment of additional objects.

* * * * *